US007266862B2

(12) United States Patent
Nam et al.

(10) Patent No.: US 7,266,862 B2
(45) Date of Patent: Sep. 11, 2007

(54) SUCTION APPARATUS OF CLEANER

(75) Inventors: Hyeun Sik Nam, Seoul (KR); Yong Woo Lee, Seoul (KR); Ho Seon Rew, Seoul (KR); Choon Myun Chung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 530 days.

(21) Appl. No.: 10/701,627

(22) Filed: Nov. 6, 2003

(65) Prior Publication Data

US 2004/0211030 A1 Oct. 28, 2004

(30) Foreign Application Priority Data

Apr. 25, 2003 (KR) ..... 10-2003-0026458

(51) Int. Cl.
*A47L 9/02* (2006.01)

(52) U.S. Cl. ..... 15/416; 15/351; 15/383

(58) Field of Classification Search ..... 15/350–353, 15/421, 375, 416, 383
See application file for complete search history.

(56) References Cited

U.S. PATENT DOCUMENTS

| | | | | |
|---|---|---|---|---|
| 2,230,077 A * | 1/1941 | Foss | ..... | 15/329 |
| 3,377,647 A * | 4/1968 | Hill et al. | ..... | 15/416 |
| 3,636,681 A * | 1/1972 | Batson et al. | ..... | 55/372 |
| 4,457,043 A * | 7/1984 | Oeberg et al. | ..... | 15/346 |
| 5,018,240 A * | 5/1991 | Holman | ..... | 15/349 |
| 7,051,401 B2 * | 5/2006 | Park | ..... | 15/416 |

FOREIGN PATENT DOCUMENTS

| | | | |
|---|---|---|---|
| GB | 2378643 | * | 2/2003 |
| JP | 2-119142 | | 9/1990 |
| JP | 06292646 A | * | 10/1994 |
| JP | 10-234629 | * | 9/1998 |
| JP | 2000083872 A | * | 3/2000 |
| JP | 2002-204767 | * | 7/2002 |
| WO | WO 00/00073 | * | 1/2000 |

* cited by examiner

*Primary Examiner*—Theresa T. Snider
(74) *Attorney, Agent, or Firm*—Greenblum & Bernstein, P.L.C.

(57) ABSTRACT

A suction apparatus of a cleaner includes: a suction motor inserted in a cleaner body and generating a suction force; a filter for collecting dust or filth sucked by a suction force generated for the suction motor; a suction head connected to the filter by a suction pipe and sucking dust and filth on the floor by the suction force generated from the suction motor; and an auxiliary suction unit installed at the opposite side of a side where the suction pipe of the suction head is connected. A cleaning performance is enhanced by compensating a suction force at a portion where the suction force is relatively weak.

9 Claims, 5 Drawing Sheets

SUCTION APPARATUS OF CLEANER

BACKGROUND OF THE INVENTION

1. Field of the Invention

The present invention relates to a suction apparatus of a cleaner and, more particularly, to a suction apparatus of a cleaner capable of improving a cleaning performance by performing a sucking concentratively on a region where a suction force is relatively weak.

2. Description of the Background Art

FIG. 1 is a perspective view of a upright cleaner and FIG. 2 is a cross-sectional view of the upright cleaner in accordance with a conventional art.

The upright cleaner includes a cleaner body 102 disposed in a vertically-standing state, a suction motor 104 inserted in the cleaner body 102 and generating a suction force, a filter 106 disposed at a suction side of the suction motor 104 and collecting dust and filth sucked by the suction force generated by the suction motor 104; a filter container 108 in which the filter 106 is installed; a suction head 110 disposed at a lower portion of the cleaner body 102 and sucking dust or filth on the floor; and a brush 112 rotatably installed at the suction head and brushing dust and filth on the floor.

A handle 101 is mounted at an upper side of the cleaner body 102, and moving wheels 116 and 118 are installed at a lower side of the suction head 110.

The suction head 110, at which the brush 112 is mounted, has certain space for sucking dust and foreign materials, and a suction hole 120 for sucking dust and foreign materials is formed at a lower side, and a suction pipe 112 for guiding dust and filth sucked through the suction hole 120 is connected to one side thereof.

Both ends of the brush 112 is rotatably support at an upper side of the suction hole 120, and rotated upon receiving a rotating force of the suction motor 104. That is, a passive pulley 132 is formed at one side of the brush 112, and a driving pulley 132 is mounted at a rotational shaft 126 of the suction motor 104. A belt 134 is connected between the driving pulley 132 and the passive pulley 132, so hat when the suction motor 104 is driven, the brush 112 is rotated. A belt cover 140 for protecting the belt 134 is mounted at the suction head 110.

In the conventional upright type cleaner, when the suction motor 104 is driven and a suction force is generated, dust and filth on the floor are sucked through the suction hole 120 and collected in the filter 106 along the suction pipe 112.

When the rotational shaft 136 of the driving motor 104 is rotated, the driving pulley 130 is rotated, and when the passive pulley 132 connected to the driving pulley 130 by the belt 134 is rotated, the brush 112 where the passive pulley 132 is formed is rotated to draw dust and foreign materials on the floor to the inside of the suction hole 120.

However, the conventional upright cleaner has the following problems.

That is, viewing from FIG. 2, the suction force of the right portion of the suction hole 120 is relatively weak compared to the left portion of the suction hole 120 to which the suction pipe 122 is connected, so a cleaning performance is degraded.

In addition, because the belt cover 140 for protecting the belt 134 is mounted at the right portion of the suction hole 120, the suction hole at the portion where the belt cover 140 is mounted is closed, so the cleaning performance is also degraded.

SUMMARY OF THE INVENTION

Therefore, an object of the present invention is to provide a suction apparatus of a cleaner capable of enhancing a cleaning performance by installing an auxiliary suction unit at a portion where a suction force is relatively weak and thus performing a cleaning evenly over every cleaning region.

To achieve these and other advantages and in accordance with the purpose of the present invention, as embodied and broadly described herein, there is provided a suction apparatus of a cleaner including: a suction motor inserted in a cleaner body and generating a suction force; a filter for collecting dust or filth sucked by a suction force generated fro the suction motor; a suction head connected to the filter by a suction pipe and sucking dust and filth on the floor by the suction force generated from the suction motor; and an auxiliary suction unit installed at the opposite side of a side where the suction pipe of the suction head is connected.

The auxiliary suction head includes: an auxiliary suction head mounted at one end portion of the suction head and sucking dust and filth; and an auxiliary suction pipe connected between the auxiliary suction head and the suction pipe and inducing the dust and filth sucked from the auxiliary suction head to the suction pipe.

The auxiliary suction head is mounted at a front side of the suction head, has a certain space to which dust and filth are sucked, and includes an auxiliary suction hole at its lower side.

The auxiliary suction pipe is disposed to be exposed outwardly of the suction head, one side of which is connected to the suction head and the other side is connected to the suction pipe.

The auxiliary suction pipe is connected between the suction head and the suction pipe, and is disposed inside the suction head.

To achieve the above objects, there is also provided a suction apparatus of a cleaner including: a suction motor inserted in a cleaner body and generating a suction force; a filter for collecting dust or filth sucked by a suction force generated fro the suction motor; a suction head connected to the filter by a suction pipe and sucking dust and filth on the floor by the suction force generated from the suction motor; a brush rotatably installed inside the suction head and receiving a rotating force by being connected to the suction motor by a belt; a belt cover mounted at the suction head and protecting the belt; and an auxiliary suction unit installed at a portion of the suction head where the belt cover is mounted and sucking dust and filth.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There can be plural embodiments of the suction apparatus of a cleaner in accordance with the present invention, of which the most preferred one will now be described.

Figure 1:
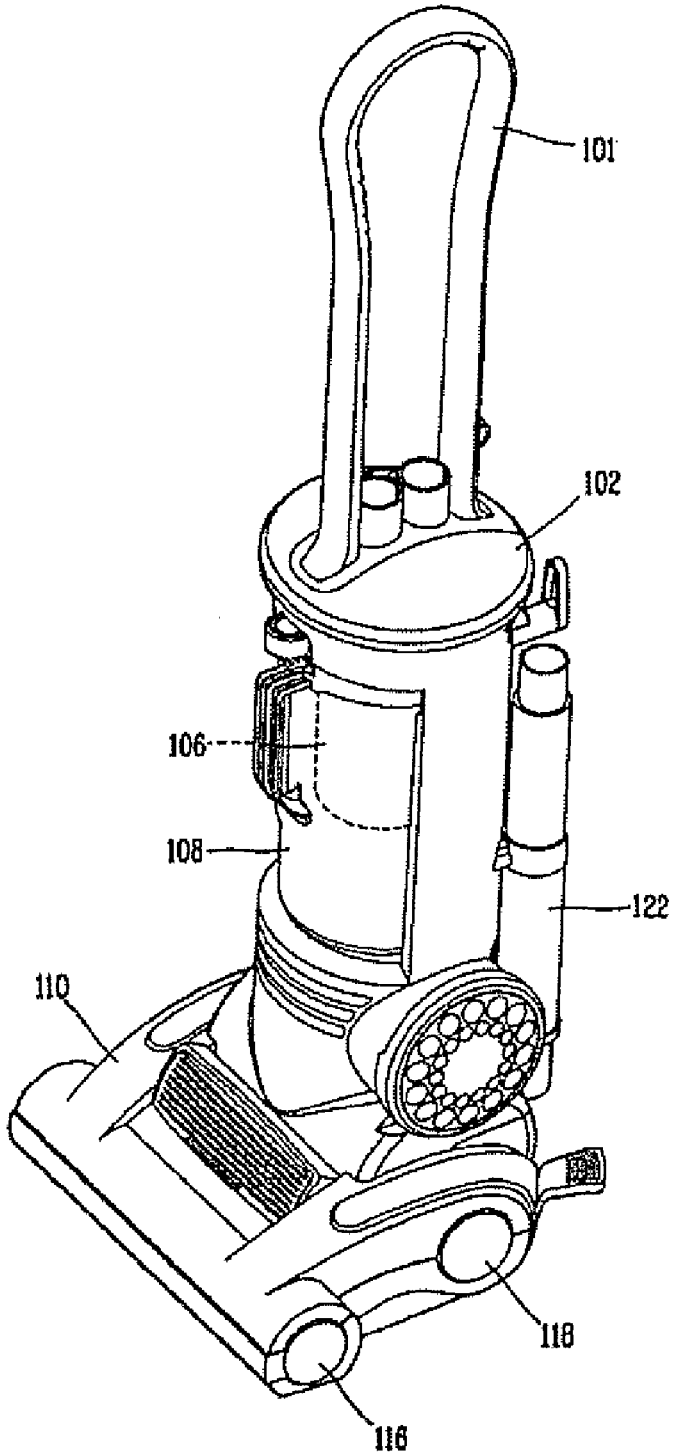
FIG. 1 CONVENTIONAL ART
FIG. 1 is a perspective view of an upright cleaner in accordance with a conventional art.
Figure 2:
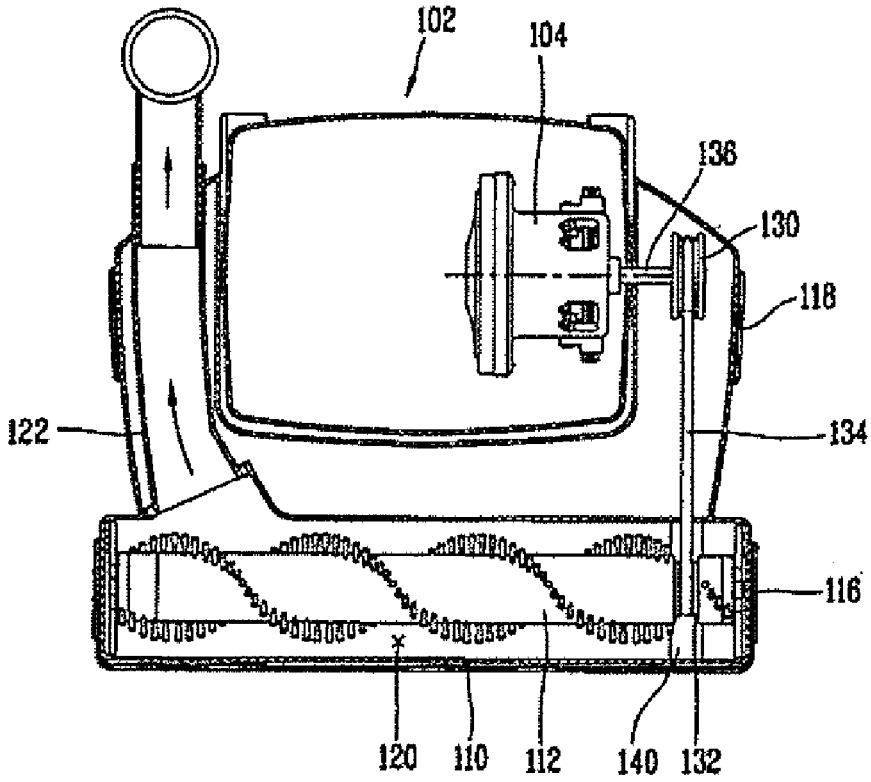
FIG. 2 CONVENTIONAL ART
FIG. 2 is a cross-sectional view of the upright cleaner in accordance with the conventional art.
Figure 3:
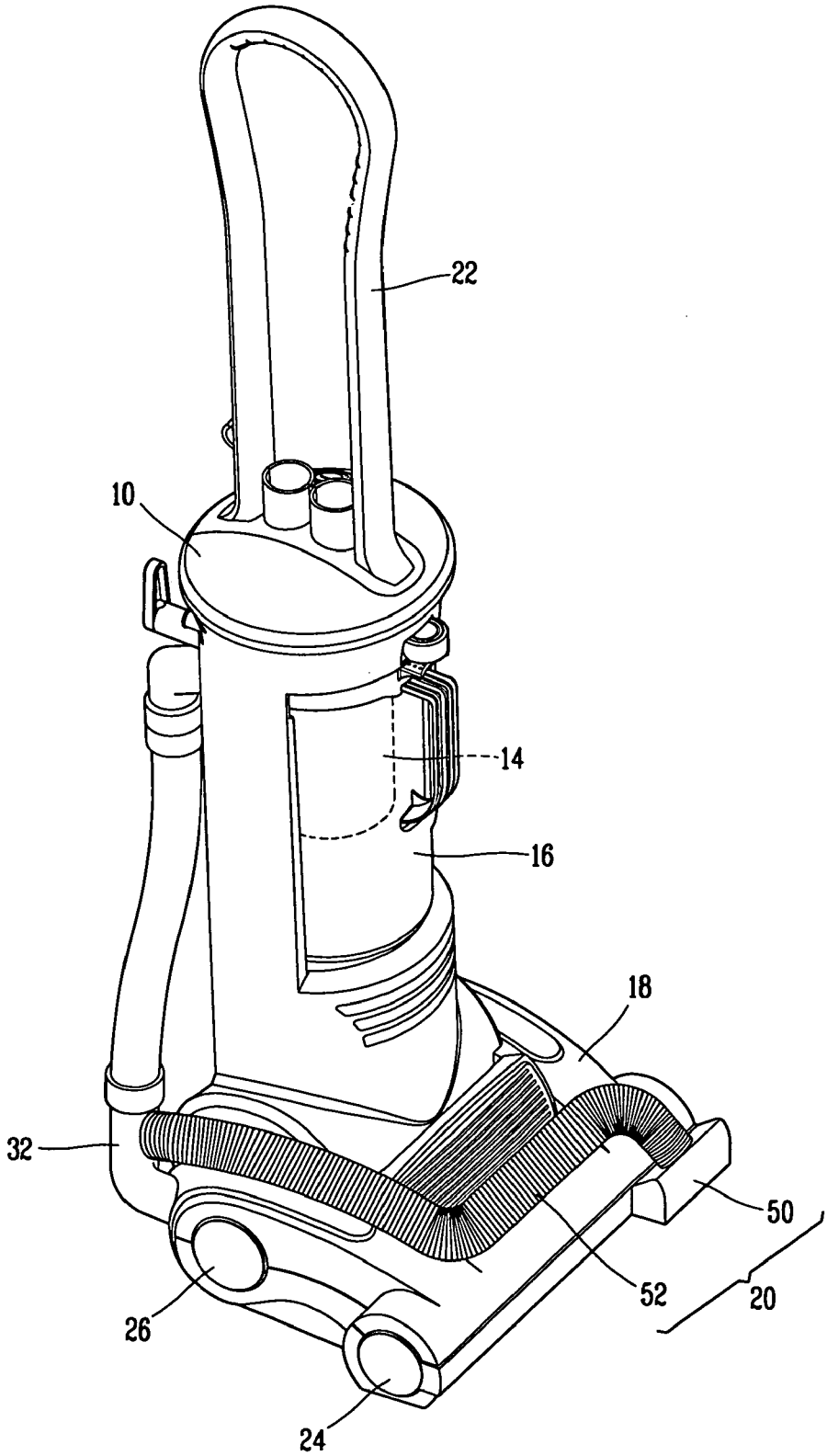
FIG. 3 is a perspective view of an upright cleaner in accordance with one embodiment of the present invention.
Figure 4:
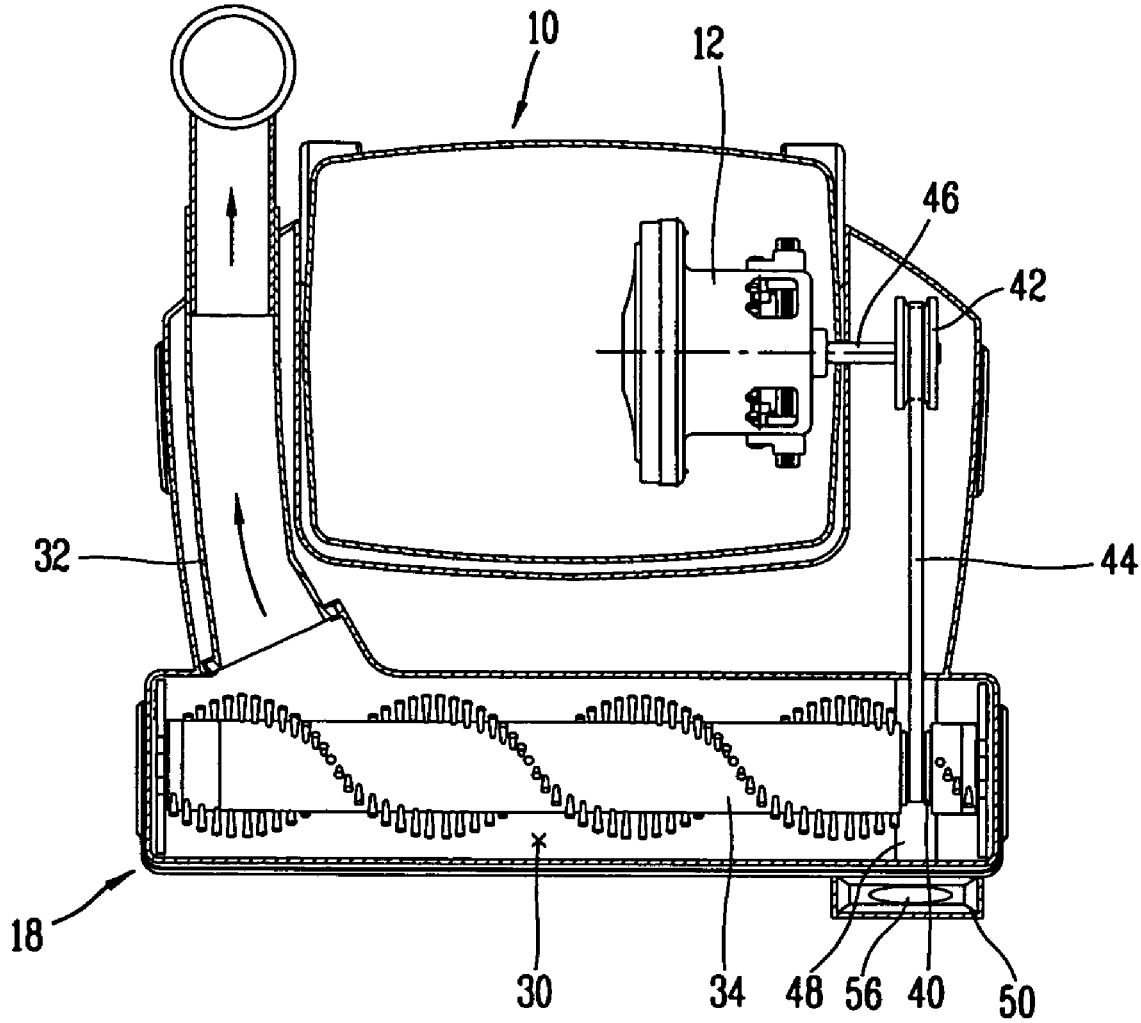
FIG. 4 is a cross-sectional view of the upright cleaner in accordance with one embodiment of the present invention.

FIG. 3 is a perspective view of an upright cleaner in accordance with one embodiment of the present invention, and FIG. 4 is a cross-sectional view of the upright cleaner in accordance with one embodiment of the present invention.

The upright cleaner in accordance with the present invention includes a cleaner body 10 disposed in a vertically-standing state, a suction motor 12 inserted in the cleaner body 10 and generating a suction force, a filter 14 disposed at a suction side of the suction motor 12 and collecting dust and filth sucked by the suction force generated by the suction motor 12; a filter container 16 in which the filter 14 is installed; a suction head 18 disposed at a lower side of the suction motor 12 and sucking dust and filth on the floor; and an auxiliary suction unit 20 for sucking dust and filth on the floor separately from the suction head 18.

A handle 22 is mounted at an upper side of the cleaner body 10, and moving wheels 24 and 26 are mounted at a lower side of the suction head 18.

As for the suction head 18, it has a certain space into which sucked dust and filth can be introduced, and a suction hole 30 into which dust and filth are sucked is formed at a lower side of the suction head 18. At one side thereof a suction pipe 32 is connected to induce dust and filth sucked into the suction hole 30 to the filter 14. A brush 34 for brushing dust and filth on the floor to the inside of the suction head 18 is rotatably installed therein.

Both ends of the brush 34 is rotatably supported inside the suction head 18, and the brush 34 draws up dust and fifth by being rotated by a rotating force generated from the suction motor 12. In other words, a passive pulley 40 is formed at one side of the brush 34, and a driving pulley 42 is mounted at a rotational shaft 46 of the suction motor 12. The passive pulley 40 and the driving pulley 42 are connected by the belt 44. Accordingly, when the rotational shaft 46 of the suction motor 12 is rotated, the driving pulley 42 is rotated and the passive pulley 40 is rotated by the belt 44, thereby rotating the brush 34.

At one side of the suction head 18, a belt cover 48 is mounted to protect a belt 44.

The auxiliary suction unit 20 includes: an auxiliary suction head 50 mounted at a front side of the suction head 18 and sucking dust and filth independently from the suction hole 30, and an auxiliary suction pipe 52 connected between the suction head 50 and inducing dust sucked into the auxiliary suction head 50 to the suction pipe 32.

The auxiliary suction head 50 is installed at a portion of the suction hole 30 of the suction head 18 where a suction force is relatively weak.

Viewing from FIG. 4, the suction pipe 32 is connected at the left side of the suction hole, so the suction force at the right side of the suction hole 30 is relatively weak. Thus, the auxiliary suction head 50 is mounted at the front side of the suction head 18, the portion corresponding to the right side of the suction hole 30, to compensate the weak suction force.

Meanwhile, because the belt cover 48 is installed at the right region of the suction hole 30, the suction hole 30 is covered by the belt cover 48, interrupting a cleaning operation. Thus, the auxiliary suction head 50 is installed at the suction head 18 corresponding to the right side of the suction hole 30 which is covered by the belt cover 48, in order to ensure a smooth cleaning operation.

As shown in FIG. 3, the auxiliary suction pipe 52 is disposed outside the suction head 18, and one side of which is connected to an upper side of the suction head and the other side thereof is connected to the suction pipe 32.

The operation of the suction apparatus of a cleaner constructed as described will now be explained.

When the suction motor 12 is driven by a user's manipulation, a suction force is generated, dust and filth on the floor are sucked through the suction hole 30 of the suction head 18 and collected at the filter 14 along the suction pipe 32.

And as the brush 34 is rotated, dust and filth are drawn into the suction hole 30. That is, when the rotational shaft 46 of the driving motor 12 is rotated, the driving pulley 42 mounted at the rotational shaft 46 is rotated, and as the passive pulley 40 connected to the driving pulley 42 by the belt 44 is rotated, the brush 34 is rotated.

As for the suction hole 30, the suction force at the opposite portion of the portion where the suction pipe 32 is connected is relatively weak, and in addition, because the belt cover 48 is mounted to protect the belt 44, the suction performance is further weakened. Such weak suction force is compensated by the auxiliary suction unit 20.

In other words, the auxiliary suction head 50 of the auxiliary suction unit 20 is installed at the suction head 18 at the opposite portion of the suction hole 30 where the suction pipe 32 is connected, to thereby suction dust and filth at the portion where the suction force of the suction hole 30 is weak, and the dust and filth sucked into the auxiliary suction head 50 are introduced into the suction pipe 32 through the auxiliary suction pipe 52 and collected to the filter 14.

Figure 5:
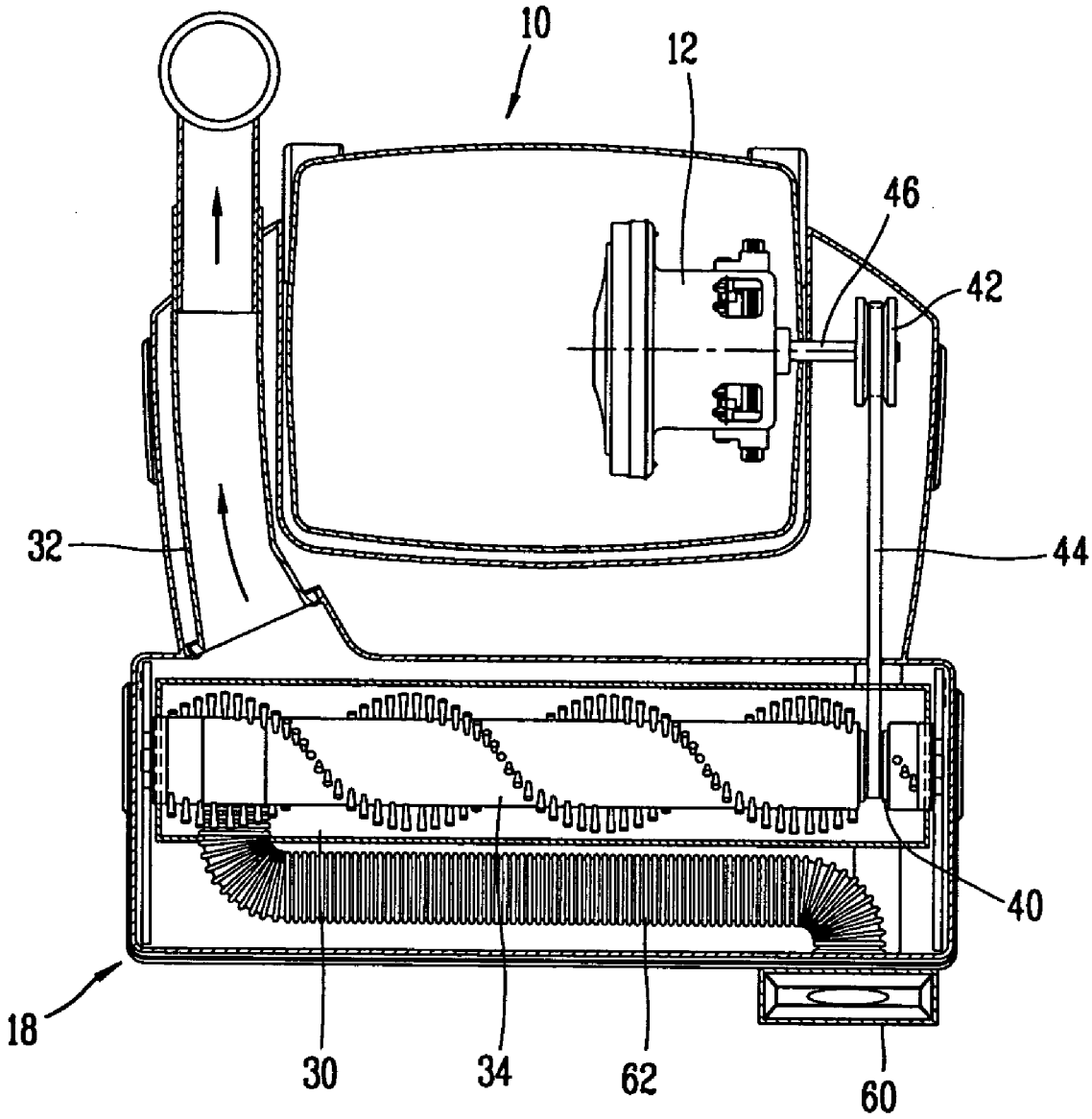
FIG. 5 is a cross-sectional view of an upright cleaner in accordance with another embodiment of the present invention.

FIG. 5 is a cross-sectional view of an upright cleaner in accordance with another embodiment of the present invention.

The suction apparatus of a cleaner in accordance with another embodiment of the present invention has an auxiliary suction unit which has the same construction as that of the former embodiment.

The auxiliary suction unit in accordance with another embodiment of the present invention includes an auxiliary suction head 60 for sucking dust and filth independently from the suction hole 30 at the front side of the suction head 18, and an auxiliary suction pipe 62 disposed inside the suction head 18 and connected between the suction head 18 and the suction pipe 32.

The auxiliary suction head 60 has the same construction as the auxiliary suction head 50 in the former embodiment, descriptions of which are thus omitted.

The auxiliary suction pipe 62 is disposed inside the suction head 18, one side of which is connected to the suction head 18 and the other side is connected to a portion where the suction head 18 and the suction pipe 32 are connected in order to induce the dust and filth sucked from the auxiliary suction head 60 to the suction pipe 32.

As so far described, the suction apparatus of a cleaner in accordance with the present invention has the following advantages.

That is, because the suction hole region at the opposite side of the suction hole region where the suction pipe is connected is distant from the suction pipe, a suction force at the region is relatively weak. Thus, the suction force is compensated by installing the auxiliary suction head, so that a cleaning performance can be improved.

In addition, a portion of the suction hole is closed by the belt cover protecting a belt connected between the brush and the suction motor for driving the brush. Thus, an auxiliary suction head is installed at the portion where the belt cover is mounted to generate a suction force, thereby enhancing a cleaning performance.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A suction apparatus of a cleaner comprising:

a suction motor inserted in a cleaner body and generating a suction force;

a filter that collects dust or filth sucked by a suction force generated from the suction motor;

a suction head connected to the filter by a suction pipe and sucking dust and filth on a floor by the suction force generated from the suction motor; and an auxiliary suction unit installed at the opposite side of a side where the suction pipe of the suction head is connected and a suction force is weak, wherein the suction head and the suction unit are configured to be operated together to compensate for the weak suction force to thereby suck dust and filth, wherein the auxiliary suction unit comprises:

an auxiliary suction head mounted at one end portion of the suction head and sucking dust and filth; and an auxiliary suction pipe connected between the auxiliary suction head and the suction pipe and inducing the dust and filth sucked from the auxiliary suction head to the suction pipe.

2. The apparatus of claim 1, wherein the auxiliary suction head is mounted at a front side of the suction head, has a certain space to which dust and filth are sucked, and includes an auxiliary suction hole at its lower side.

3. The apparatus of claim 1, wherein the auxiliary suction pipe is disposed to be exposed outwardly of the suction head, one side of which is connected to the suction head and the other side is connected to the suction pipe.

4. The apparatus of claim 1, wherein the auxiliary suction pipe is connected between the suction head and the suction pipe, and is disposed inside the suction head.

5. A suction apparatus of a cleaner comprising:

a suction motor inserted in a cleaner body and generating a suction force;

a filter for collecting dust or filth sucked by a suction force generated from the suction motor;

a suction head connected to the filter by a suction pipe and sucking dust and filth on a floor by the suction force generated from the suction motor;

a brush rotatably installed inside the suction head and receiving a rotating force by being connected to the suction motor by a belt;

a belt cover mounted at the suction head and protecting the belt; and an auxiliary suction unit installed at a portion of the suction head where the belt cover is mounted and a suction force is weak, wherein the suction head and the suction unit are configured to be operated together to compensate for the weak suction force to thereby suck dust and filth.

6. The suction apparatus of claim 5, wherein the auxiliary suction unit comprises:

an auxiliary suction head mounted at one end portion of the suction head and sucking dust and filth; and an auxiliary suction pipe connected between the auxiliary suction head and the suction pipe and inducing the dust and filth sucked from the auxiliary suction head to the suction pipe.

7. The apparatus of claim 5, wherein the auxiliary suction head is mounted at a front side of the suction head, has a certain space to which dust and filth are sucked, and includes an auxiliary suction hole at its lower side.

8. The apparatus of claim 5, wherein the auxiliary suction pipe is disposed to be exposed outwardly of the suction head, one side of which is connected to the suction head and the other side is connected to the suction pipe.

9. The apparatus of claim 5, wherein the auxiliary suction pipe is connected between the suction head and the suction pipe, and is disposed inside the suction head.

* * * * *